United States Patent [19]

Ventura et al.

[11] Patent Number: 4,598,909

[45] Date of Patent: Jul. 8, 1986

[54] SOFT GAME BALL INCLUDING MOVEABLE LUBRICATED CORE

[75] Inventors: Frank D. Ventura, Newburyport; Randall H. Moormann, Georgetown, both of Mass.

[73] Assignee: CPG Products Corp., Minneapolis, Minn.

[21] Appl. No.: 686,311

[22] Filed: Dec. 24, 1984

[51] Int. Cl.[4] ..... A63B 37/00

[52] U.S. Cl. ..... 273/60 B; 273/DIG. 8; 273/DIG. 29; 273/58 F

[58] Field of Search ..... 273/58 A, 60 R, 60 A, 273/60 B, 199 R, DIG. 8, DIG. 22, DIG. 20, 58 F

[56] References Cited

U.S. PATENT DOCUMENTS

| | | | |
|---|---|---|---|
| 1,262,532 | 4/1918 | McElroy | 273/199 R |
| 1,873,221 | 8/1932 | Senn | 273/60 R |
| 3,942,793 | 3/1976 | Lombardo | 273/DIG. 20 X |
| 4,274,637 | 6/1981 | Molitor | 273/DIG. 8 X |
| 4,431,193 | 2/1984 | Nesbitt | 273/DIG. 22 X |
| 4,462,589 | 7/1984 | Morgan | 273/60 R |
| 4,463,951 | 8/1984 | Kumasaka | 273/58 A |
| 4,529,200 | 7/1985 | Miller et al. | 273/60 B |

FOREIGN PATENT DOCUMENTS

| | | | |
|---|---|---|---|
| 493100 | 5/1953 | Canada | 273/60 R |
| 2508804 | 1/1983 | France | 273/58 A |

*Primary Examiner*—George J. Marlo

*Attorney, Agent, or Firm*—Gene O. Enockson; L. MeRoy Lillehaugen; Stuart R. Peterson

[57] ABSTRACT

A game ball is comprised of an outer layer of foamed polyurethane plastic having a density of approximately 15 pounds per cubic foot, the layer having an external integral skin having a density of 20–30 pounds per cubic foot providing a protective cover and an integral inner skin having a density of 20–30 pounds per cubic foot providing a cavity in which a core ball of resilient material is contained. The core ball has a density of 70–76 pounds per cubic foot and a lesser degree of compressibility than the foamed layer of polyurethane plastic. The core ball is lubricated by carbon contained in the core ball when fabricated from natural rubber and by means of a lubricating film when fabricated from natural rubber and polybutadiene so that in either case the core ball is free to move or shift within the cavity when the baseball is impacted by a bat.

23 Claims, 4 Drawing Figures

NATURAL RUBBER IMPREGNATED WITH POWDERED CARBON
OR
POLYBUTA DIENE WITH NATURAL RUBBER AND LUBRICATING FILM

SOFT GAME BALL INCLUDING MOVEABLE LUBRICATED CORE

BACKGROUND OF THE INVENTION

1. Field of the Invention

This invention relates generally to a game ball, and pertains more particularly to a baseball or softball having an outer layer of foamed plastic and a weighted center in the form of a resilient spherical core that is freely movable within a central cavity formed within the foamed plastic layer.

2. Description of the Prior Art

Various efforts have been made in the past to simulate the playing characteristics of various game balls. Examples of such attempts are disclosed in the U.S. Pat. No. 2,743,931 issued on May 1, 1956 to Pooley et al for "PRACTICE OR PLAY BALL AND METHOD OF MAKING SAME"; U.S. Pat. No. 3,069,170 granted on Dec. 18, 1962 to J. A. Dillon, Jr. for "PRACTICE BALL"; U.S. Pat. No. 4,149,720 issued on April 17, 1979 to Jesse H. Heald, Jr. for "BALL AND METHOD OF MAKING SAME"; U.S. Pat. No. 4,462,589, issued on July 31, 1984 to Robert C. Morgen for "GAME BALL," and U.S. Pat. No. 4,463,951 to Kumasake for "BALL."

While each of the above-identified patented balls makes use of a foamed material, the resulting products, although corresponding in size and general appearance to, say, a hard regulation baseball or softball, do not possess other normally expected properties, such as true flight patterns, adequate weight and durability. It should be recognized that baseballs and softballs are subjected to relatively severe impact forces when struck by a conventional bat. Consequently, the prior art has not produced a completely acceptable baseball or softball.

SUMMARY OF THE INVENTION

An object of the present invention is to provide a game ball that will generally possess the basic qualities of a regulation baseball or softball. Perhaps the most looked for qualities in a baseball are ruggedness and durability. In this regard, a specific aim of the invention is to provide a game ball that will withstand the usual forces experienced when struck by a conventional bat. It is also within the purview of my invention to provide an integral outer skin that helps resist wear and moisture.

Another object of the invention is to provide a game ball that, while deformable, will quickly resume its original shape after having been distorted by relatively severe impact forces. Stated somewhat differently, an aim of the invention is to provide a baseball or softball possessing excellent dimensional stability under virtually all playing conditions.

Yet another object of the invention is to provide a game ball that will be less likely to injure participants or bystanders. In this regard, some sacrifice is made in the realism of our ball in that its surface is not made as hard as a regulation baseball or softball. A ball when fabricated in accordance with the teachings of the present invention, will be generally suited for most playing conditions, yet because of its softness affords a higher degree of safety. The softness, and the safety factor resulting therefrom, encourages its widespread use, whether simulating a hard or softball, by players of virtually all ages. Also to be taken into account is the overall mass of our game ball. In this regard, it is sufficiently lightweight so that it is less apt, even when hit by a bat and striking someone at close range, to injure anyone.

Briefly, our game ball comprises an outer layer of foamed plastic, which layer has an integral surface skin that functions as a protective cover for the relatively soft and fragile foamed material. There is also an inner skin integral with the foamed plastic that forms a central cavity in which a spherical resilient core is contained. While the rubber-like spherical core has a relatively great density when compared with the density of the foamed outer layer, the spherical core also possesses a much higher degree of resiliency than the foamed layer. In this regard, the material constituting the spherical core is selected to provide a rebound factor on the order of 50 percent, whereas the rebound factor of the composite or complete baseball due to the foamed layer is only on the order of 25 percent. Thus, the foamed layer provides a cushioning or damping effect for the centrally disposed resilient core ball.

It is important that the weighted center, that is, the resilient spherical core be virtually devoid of flashing and free to move within the foamed layer so as not to cause the overall ball to disintegrate. More specifically, the impact forces that are applied to a baseball when hitting it with a bat causes the foam layer to compress, doing so against the centrally disposed core ball. This forces the core ball to the other side of the cavity, actually deforming the cavity in the process. If the foamed layer is adhered to the core ball so that the core ball is not free to move within the cavity, then the core ball, owing to its weight or mass, literally tears apart the surrounding foamed plastic as it attempts to move. Thus, it is extremely important that the spherical core be freely floatable or movable within a smooth spherical cavity formed at the center of the foamed outer plastic layer in order to prevent an internal rupturing from occurring followed by a complete splitting open of the baseball.

DESCRIPTION OF THE PREFERRED EMBODIMENT

Figure 1:
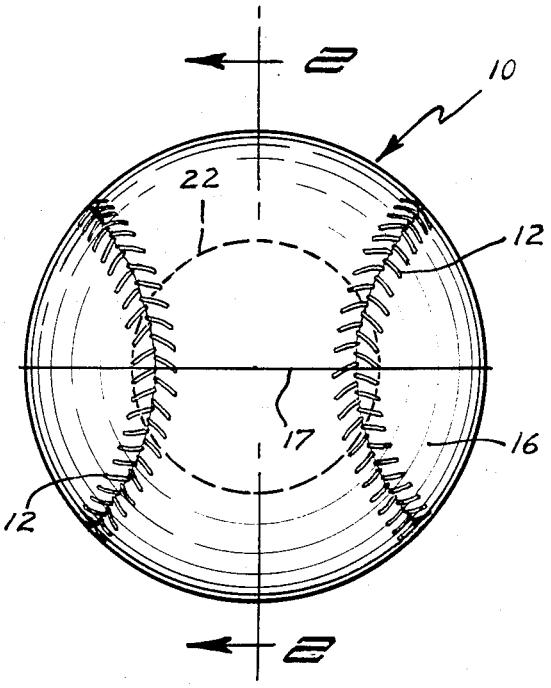
FIG. 1 is a view of a game ball fabricated in accordance with our invention.
Figure 2:
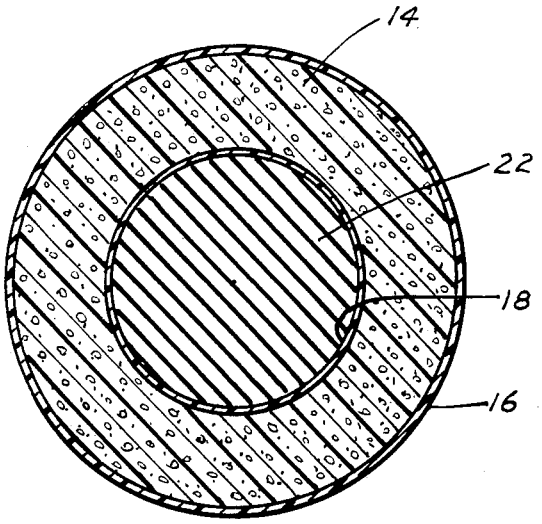
FIG. 2 is a sectional view taken in the direction of line 2—2 of FIG. 1.

The game ball in the form of a baseball or softball exemplifying our invention has been indicated generally by the reference numeral 10. The size and appearance of the game ball 10 is such as to resemble a regulation baseball and will first be described as such. Later, however, certain details will be mentioned pertaining to a game ball in the form of a softball. Thus, in actual practice, the diameter of the ball 10 is on the order of 3.0 inches. Imparting realism to the ball 10 are simulated seams or stitching labeled 12 which is formed by means of suitable indentations or impressions incorporated in the surfaces of the dies constituting the mold used in fabricating the baseball 10.

The baseball 10 comprises an outer layer of foamed polyurethane, the porous plastic layer being indicated generally by the reference numeral 14. The radial thickness of the layer 14 is approximately 0.8 inch.

Figure 4:
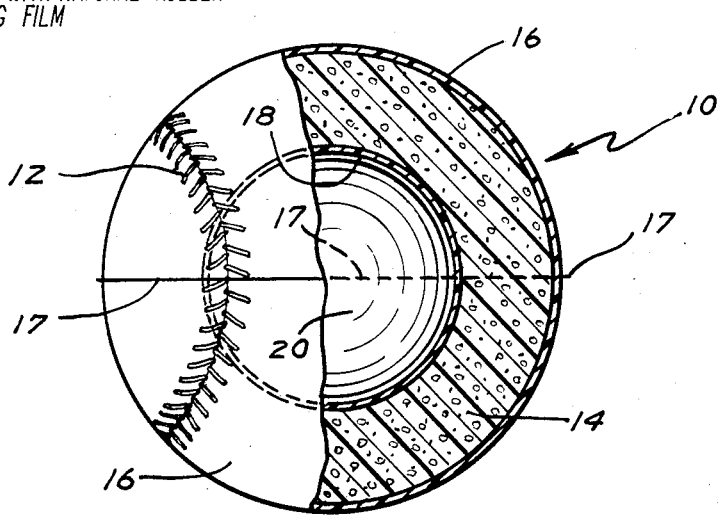
FIG. 4 is a view similar to FIG. 1 but with a substantial portion of the game ball broken away so as to show the cavity in which the core ball normally resides.

The foamed plastic layer 14 has an outer integral skin 16 that provides a protective cover for the ball 10. The relatively thin skin 16 is formed by suitably cooling the mold in which the ball 10 is fabricated. The two-part mold, which has not been illustrated, produces a typical flash 17 along the parting line, which must be trimmed to within 0.02 inch, inasmuch as such an amount does not adversely affect the ball's bounce or flight path. The thickness of the skin is a minimum of 0.03 inch. Inasmuch as the skin 16 influences the life span of the ball 10, and to some degree its characteristics, its thickness should be carefully controlled. Whereas the layer 14 has an outer skin 16, it also has an inner skin 18 that is somewhat thinner, being on the order of 0.02 inch (generally between 0.01 and 0.03 inch). The inner skin 18 forms a central spherical cavity 20, the cavity 20 being best viewed in FIG. 4. It is extremely important that this cavity 20 possess a smooth and uninterrupted surface, the reason for which will soon become clear.

Playing an important role in the realization of our invention is a spherical core or core ball 22 of an elastomeric material having a diameter on the order of 1.37 inches. The core ball 22 is relatively dense and quite resilient, possessing a rebound factor of at least 50 percent. A natural rubber impregnated with powdered carbon can be utilized. A second rubber-like material that can constitute the core ball 22 is polybutadiene, preferably combined with a small percentage of natural rubber. Polybutadiene, it should be pointed out is too weak by itself. Consequently, it is desirable to mix polybutadiene with at least some natural rubber. When so mixed, carbon is not employed, but a surface lubricant is used as will be soon explained. The mixed composition, that is natural rubber and polybutadiene should be blended so as to still obtain at least the 50 percent rebound factor for the resulting spherical core 22. In either instance the natural rubber or polybutadiene/rubber should have a tensile strength of at least 800 pounds per square inch and a minimum elongation of 500 percent.

Figure 3:
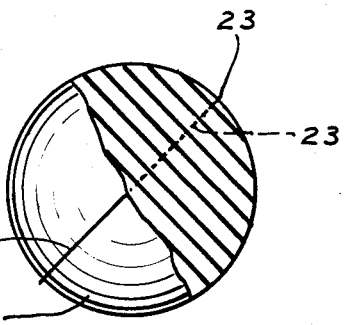
FIG. 3 is a view of the core ball before its flash is removed and prior to its being placed into the mold in which the foaming of the outer layer takes place, a segment of the ball having been removed to show the same rubbery cross sectional makeup as in FIG. 2.

Inasmuch as the core ball 22 is molded, being molded in advance of molding the game ball containing the core ball 20 therein, a flash 23 (see FIG. 3) is formed thereon. It is imperative that this flash 23, when comparatively thin, for all intents and purposes be removed in order to provide a surface as smooth as possible, although a flash of 0.005 inch width and/or height can be tolerated. In practice, the flash 23 should preferably be completely removed. If not removed, the flash 23, because of its thinness, ultimately produces a fracture or rupture in the completed ball 10. What occurs is that the thin flash absorbs heat from the polyurethane during the foaming thereof, thereby interfering with the forming of the skin 18 in the region of the circumferentially extending flash 23. Consequently, the flash 23, when present, is instrumental in molding a "crack" in the skin 18, which, as will be better comprehended hereinafter, induces the above-mentioned fracture or rupture. The reason for using carbon will soon become manifest. The two principal criteria are that the core ball 22 be quite resilient and relatively heavy. The mentioned materials enable these requirements to be met.

Whereas the foamed polyurethane layer 14 has a density on the order of 15 pounds per cubic foot (more specifically, in the general range of 13–16 pounds per cubic foot), the core ball 22 has a much greater density, the core ball 22 possessing in practice a density on the order of 73 pounds per cubic foot (more specifically in the general range of 70–76 pounds per cubic foot). It can be pointed out also that the density of the outer and inner skins 16 and 18 is on the order of 25 pounds per cubic foot (falling generally within the range of from 20 to 30 pounds per cubic foot). It is essential that the core ball 22 be movable within the cavity. If there is adhesion between the foamed layer 14, more specifically the inner skin 18, and the core ball 22, then, when the ball 10 is struck with a bat, the impact forces compress the foamed material 14, forcing the foamed material 14 against one surface portion of the centrally disposed core ball 22. The compression of the layer 14, however, causes the core ball 22 to move, when made free to do so as done when following the teachings of our invention, from the side of the cavity 20 that the compressed foamed material engages to the other side of the cavity 20.

While the impact forces provide only a transitory movement of the core ball 22, nonetheless the core ball 22 must be freely movable; otherwise, the adherence of any portion of the outer layer 14 or the inner skin 18 thereto would simply move with the core ball 22 and the distortion would provide a tearing action that would soon disintegrate the entire ball 10 after only a relatively few impact blows. The ball 22 thereby moves from one side of the cavity 20 to the other side thereof, momentarily compressing the foamed material 14 on the opposite side. However, owing to the compressibility of the foamed layer 14 and also the lesser degree of compressibility of the core ball 22, the ball 10 quickly resumes its spherical shape. In other words, although the ball 10 is momentarily deformed, the composite construction thereof enables it to rapidly return to its initial or undistorted shape. It should be apparent that if a so-called crack in the inner skin (due to the flash 23 draining away heat from the foamed polyurethane) forms the relatively severe forces developed by the movement of the core ball 22 within the cavity 20 will quickly cause the skin 18 to rupture, readily followed by the rupture of the foamed layer and its outer skin 16.

It should be recognized that the dimensions of the cavity 20 correspond closely to those of the core ball 22. This fit is realized by foaming the plastic layer 14 about the core ball 22 in a two-part mold, the core ball 22 being held centrally in the mold through the agency of one or more supporting pins. It is during this step that the previously mentioned crack in the inner skin 18 occurs if the excess plastic or flash 23 formed along the mold's parting line is not removed, for the heat absorbed by the thin flash 23, if not removed or substantially so, creates this weakened line. Therefore, it is very important that the surface of the core ball 22 be smooth, which in turn insures a smooth skin 18 that forms the spherical cavity 20. Once again, the freedom of movement of the core ball 22 within the cavity 20 is absolutely critical.

Natural rubber when impregnated with carbon enables the core ball 22 to freely float in the cavity 20.

The use of natural rubber and polybutadiene, on the other hand, necessitates the application of a lubricant that is inert to both the polyurethane and the polybutadiene. Providing a suitable lubricating film for the surface of the core ball 22 when comprised of rubber and polybutadiene can be: (1) silicone base oil, or (2) paraffin base oil.

From the foregoing description it should be obvious that the core ball 22 should be as free to move or shift within the cavity 20 as possible.

The higher density of the material constituting the core ball 22, it will be understood, adds considerable mass or weight to the center of the ball 10 so as to more closely simulate the play of a hard regulation ball. In practice the core ball 22 weighs on the order of 25 grams (desirably from 20 to 30 grams) whereas the total weight of the composite baseball is on the order of 65 grams (generally from 50 grams to 80 grams). However, it is not intended that the characteristics of the ball 10 precisely resemble a hard regulation ball, for one of the features of the invention resides in the fact that the ball 10 is relatively soft in comparison with a hard regulation ball. Yet, the properties of our ball 10 are such as to provide a game ball 10 that will resemble a regulation baseball as far as its flight pattern and durability are concerned. In other words, the relatively soft foam outer layer 14 affords a higher degree of safety, preventing injuries to participants and those nearby. The outer skin 16, which functions as a cover, resists wear and thwarts the entrance of moisture into the pore of the foamed material 14. While the outer skin 16 is not completely impervious to the entrance of moisture, painting the skin 16 with a barrier coat of polyurethane or latex paint (not illustrated) serves to coat the outer surface of the ball and to provide a realistic and aesthetic color. Over a period of extended use, though, the paint, owing to the flexing of the skin 16 which it overlies, can wear off.

The outer skin 16 and the foamed layer 14 underlying same should possess an indentation hardness having a durometer value within the rather broad range of from 20–45 shore A, the lower end of the range providing greater safety and the higher end of the range providing a game ball more closely resembling a hard regulation baseball. The durometer value of the core ball 22 is also important because it, in conjunction with the foam layer 14 and its skin 16, influences the performance of the ball 10. Therefore, the core ball 22, in order to obtain the general or overall properties, particularly the rebound factor thereof, of the ball 10, should have a durometer between 40 and 55 (more specifically, from 40–45 shore A when natural rubber/polybutadiene is employed for the core 22 and 50–55 when only natural rubber is employed).

Thus, the overall construction of the ball 10 is such that our ball 10 possesses most of the properties needed to provide a sufficiently realistic baseball so that it has a high degree of appeal and acceptance.

The foregoing techniques and sizes provide a commercially acceptable baseball. However, as earlier herein indicated our concepts can be used to provide a softball. Mainly, one only has to change the dimensions to produce a game ball simulating the usual softball. In this regard the outside diameter would be increased to approximately 3.75 inches. The core 22 would have a diameter on the order of 1.75 inches. In this way, where the same densities are used as before, the resulting softball would weigh on the order of 135 grams (generally within the range of from 100 to 150 grams), the core 22 under these conditions weighing on the order of 55 grams (generally within the range from 50 to 60 grams).

Inasmuch as the outer diameter is greater for the game ball 10 when constituting a softball and the core ball 22 is larger, the thickness of the layer 14 is likewise changed, becoming approximately 1.0 inch.

We claim:

1. A game ball comprising an outer layer of a first material having a generally spherical cavity therewithin, said layer having a substantial radial thickness, and an inner generally spherical core of a second material, means for enabling said inner core to move within and relative to said cavity when subjected to a force exerted thereagainst, said first material possessing a lesser density and a greater degree of compressibility than said second material, and the dimensions of said core corresponding to the dimensions of said cavity when neither of said materials is compressed, whereby when the exterior of said layer is impacted to compress said first material at one side of said core to exert said force against said core, said core shifts within said cavity to momentarily compress said first material at the other side of said core and at the same time to deform said cavity to avoid splitting said outer layer.

2. A game ball in accordance with claim 1 in which the material constituting said outer layer is a foamed plastic.

3. A game ball in accordance with claim 2 in which said foamed plastic material is polyurethane.

4. A game ball in accordance with claim 2 in which said foamed layer has an outer skin forming a protective cover for said foamed plastic, said outer skin being integral with said foamed layer.

5. A game ball in accordance with claim 4 in which said outer skin has a thickness of at least 0.03 inch.

6. A game ball in accordance with claim 4 in which said foamed layer has an inner skin forming said cavity, said inner skin being integral with said foamed layer.

7. A game ball in accordance with claim 6 in which said inner skin is thinner than said outer skin.

8. A game ball in accordance with claim 7 in which said core is an elastomeric material.

9. A game ball in accordance with claim 8 in which said core has a smooth surface.

10. A game ball in accordance with claim 9 in which said core is a molded core and has had its flash substantially removed to provide said smooth surface.

11. A game ball in accordance with claim 10 in which said cavity has a smooth surface resulting from the molding of said inner skin about said core.

12. A game ball in accordance with claim 6 in which said core has a diameter on the order of 1.375 inches and said foam layer has a radial thickness on the order of 0.80 inch, thereby simulating a baseball.

13. A game ball in accordance with claim 6 in which said core has a diameter on the order of 1.75 inches and said foamed layer has a radial thickness on the order of 1.0 inch, thereby simulating a softball.

14. A game ball in accordance with claim 2 in which said foamed layer has an inner skin forming said cavity, said inner skin being integral with said foamed layer.

15. A game ball in accordance with claim 14 in which said inner skin has a thickness on the order of 0.02 inch.

16. A game ball in accordance with claim 1 in which said core has a lubricated surface.

17. A game ball in accordance with claim 1 in which said core is of natural rubber.

18. A game ball in accordance with claim 17 in which said core is impregnated with carbon to provide sufficient surface lubrication to assure that said core is free to move within said cavity.

19. A game ball in accordance with claim 1 in which said core is composed of natural rubber and polybutadiene.

20. A game ball in accordance with claim 19 in which said core has a lubricated surface to assure that said core is free to move within said cavity.

21. A game ball comprising an outer layer of foamed plastic material having a density on the order of 15 pounds per cubic inch and forming a spherical cavity therewithin, and a core ball in said cavity, said core ball being formed of an elastomeric material having a density on the order of 73 pounds per cubic foot, said foamed plastic material possessing a greater degree of compressibility than said elastomeric material and having a radial thickness of approximately from 0.80 to 1.0 inch, means for enabling said core ball to move within and relative to said cavity when subjected to a force exerted thereagainst, and the diameter of said core ball corresponding to the diameter of said cavity when neither of said materials is compressed.

22. A game ball in accordance with claim 21 in which said foamed plastic material has an outer skin thereon and an inner skin forming said cavity, said skins having a density on the order of 25 pounds per cubic foot.

23. A game ball in accordance with claim 22 in which said outer skin has a thickness of at least 0.03 inch and said inner skin has a thickness on the order of 0.02 inch.

* * * * *